US005159824A

United States Patent [19]

Stewart, Jr.

[11] Patent Number: 5,159,824

[45] Date of Patent: Nov. 3, 1992

[54] APPARATUS FOR HIGH VELOCITY DYE DRAINAGE

[75] Inventor: William H. Stewart, Jr., Campobello, S.C.

[73] Assignee: Milliken Research Corporation, Spartanburg, S.C.

[21] Appl. No.: 699,158

[22] Filed: May 13, 1991

[51] Int. Cl.[5] ..... D06B 1/02

[52] U.S. Cl. ..... 68/205 R

[58] Field of Search ..... 68/205 R

[56] References Cited

U.S. PATENT DOCUMENTS

| | | | |
|---|---|---|---|
| 3,393,411 | 7/1968 | McElveen | 8/151 |
| 3,683,649 | 8/1972 | Takriti et al. | 68/5 D |
| 3,688,530 | 9/1972 | Harris et al. | 68/205 R |
| 3,731,503 | 5/1973 | Appenzeller et al. | 68/205 R |
| 3,892,109 | 7/1975 | Klein et al. | 68/205 R |
| 3,894,413 | 7/1975 | Johnson | 68/205 R |
| 3,937,045 | 2/1976 | Klein et al. | 68/205 R |
| 3,939,675 | 2/1976 | Klein | 68/205 R |
| 3,942,342 | 3/1976 | Klein et al. | 68/205 R |
| 3,942,343 | 3/1976 | Klein | 68/205 R |
| 3,969,779 | 7/1976 | Stewart, Jr. | 8/149 |
| 3,985,006 | 10/1976 | Klein | 68/205 R |
| 4,019,352 | 4/1977 | McCollough, Jr. et al. | 68/205 R |
| 4,033,154 | 7/1977 | Johnson | 68/205 R |
| 4,034,584 | 7/1977 | Klein et al. | 68/205 R |
| 4,055,868 | 11/1977 | O'Neill, Jr. | 8/150 |
| 4,058,991 | 11/1977 | McCollough | 68/205 R |
| 4,059,880 | 11/1977 | Klein | 29/157 |
| 4,095,444 | 6/1978 | Pascoe, Sr. et al. | 68/205 R |
| 4,097,946 | 7/1978 | McCollough | 8/150 |
| 4,116,626 | 7/1978 | Varner | 8/149 |
| 4,148,668 | 4/1979 | Stewart, Jr. | 134/22 C |
| 4,433,811 | 2/1984 | Godfrey | 239/74 |
| 4,434,632 | 3/1984 | McCollough, Jr. et al. | 68/205 R |
| 4,648,250 | 3/1987 | Yabe | 68/5 D |

FOREIGN PATENT DOCUMENTS

| | | |
|---|---|---|
| 0061176 | 9/1982 | European Pat. Off. . |
| 978452 | 12/1964 | United Kingdom . |
| 1201598 | 8/1970 | United Kingdom . |

*Primary Examiner*—Philip R. Coe

*Attorney, Agent, or Firm*—Kevin M. Kercher; H. William Petry

[57] ABSTRACT

An apparatus and method for alleviating the foam associated with the application of dyes or other liquids to moving textile materials, such as pile carpets, fabrics and the like. This invention may be used with machines in which arrays of individual streams of liquid dye are used to pattern substrates. There is a means for alleviating the foam created in the fluid stream utilized to treat the textile substrate.

26 Claims, 4 Drawing Sheets

APPARATUS FOR HIGH VELOCITY DYE DRAINAGE

BACKGROUND OF THE INVENTION

It is known to apply liquid dyes to moving textile materials from plural streams which are directed onto the materials and selectively controlled to produce a desired pattern thereon. McElveen U.S. Pat. No. 3,393,411 describes apparatus and process wherein plural streams of dye are selectively controlled in their flow to provide a distinct pattern on pile carpet.

U.S. Pat. Nos. 3,443,878 and 3,570,275 describe apparatus and process for the patterned dyeing of a moving textile for the patterned dyeing of a moving textile web wherein continuously flowing streams of dye normally directed in paths to impinge upon the web are selectively deflected from contact with the web in accordance with pattern information. The webs are thus dyed in a desired pattern and the deflected dye is collected and recirculated for use. Each continuously flowing dye stream is selectively deflected by a stream of air which is discharged, in accordance with pattern information, from an air outlet located adjacent each dye discharge outlet. The air outlet is positioned to direct the air stream into intersecting relation with the dye stream and to deflect the dye into a collection chamber or trough for recirculation.

It has been discovered that dyes or other liquids, when agitated, create foam which result in severe quality problems when applied to a textile web. This is especially true for dyes with a relatively high viscosity.

The present invention solves this problem and others in a manner not disclosed in the known prior art.

SUMMARY OF THE INVENTION

The present invention is directed to an apparatus for alleviating the foam associated with the application of dyes or other liquids to moving textile materials, such as pile carpets, fabrics and the like. This invention is directed to an apparatus which may be used with machines in which arrays of individual streams of liquid dye are used to pattern substrates. There is a means for alleviating the foam created in the fluid stream utilized to treat the textile substrate.

It is an advantage of this invention to be able to improve the quality and consistency of the dyed substrate.

Yet another advantage of this invention to be able to dissipate bubbles by means of an improved bypass mechanism.

Still another advantage is the continuous dispersal of unused dyestuff or other liquids so that it does not backup and contaminate the fabric.

Another advantage is the efficient removal of debris and dye aggregates.

These and other advantages will be in part obvious and in part pointed out below.

BRIEF DESCRIPTION OF THE DRAWINGS

The above as well as other advantages of the invention will become more apparent from the following detailed description of the preferred embodiments of the invention, which when taken together with the accompanying drawings, in which.

Corresponding reference characters indicate corresponding parts throughout the several views of the drawings.

DETAILED DESCRIPTION OF THE PREFERRED EMBODIMENT

Figure 1:
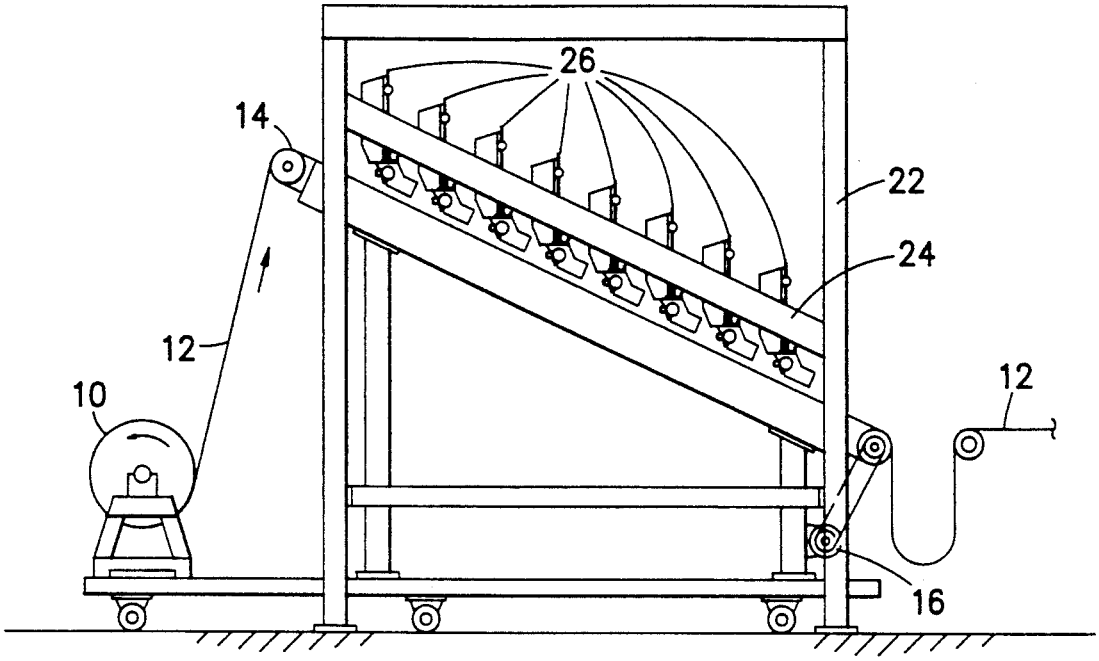
FIG. 1 represents a diagrammatic side view of the array configuration of a dyeing apparatus of a kind for which the instant invention may be adapted, depicting eight dye-emitting arrays positioned above a section of a substrate web to be patterned.

Referring now by reference numerals to the drawings and first to FIG. 1, it will be understood that FIG. 1 depicts, in a side elevational view, a set of eight individual arrays 26 positioned within frame 22. These arrays form part of a pattern dyeing machine to which the present invention is particularly suited. Each array 26 is comprised of a plurality of dye jets, arranged in spaced alignment, which extend generally above and across the width of substrate 12. Substrate 12 is supplied from roll 10 and is transported in turn under each array 26 by conveyor 14 driven by a suitable motor indicated generally at 16. After being transported under arrays 26, substrate 12 may be passed through other dyeing-related process steps such as drying, fixing, etc.

Figure 2:
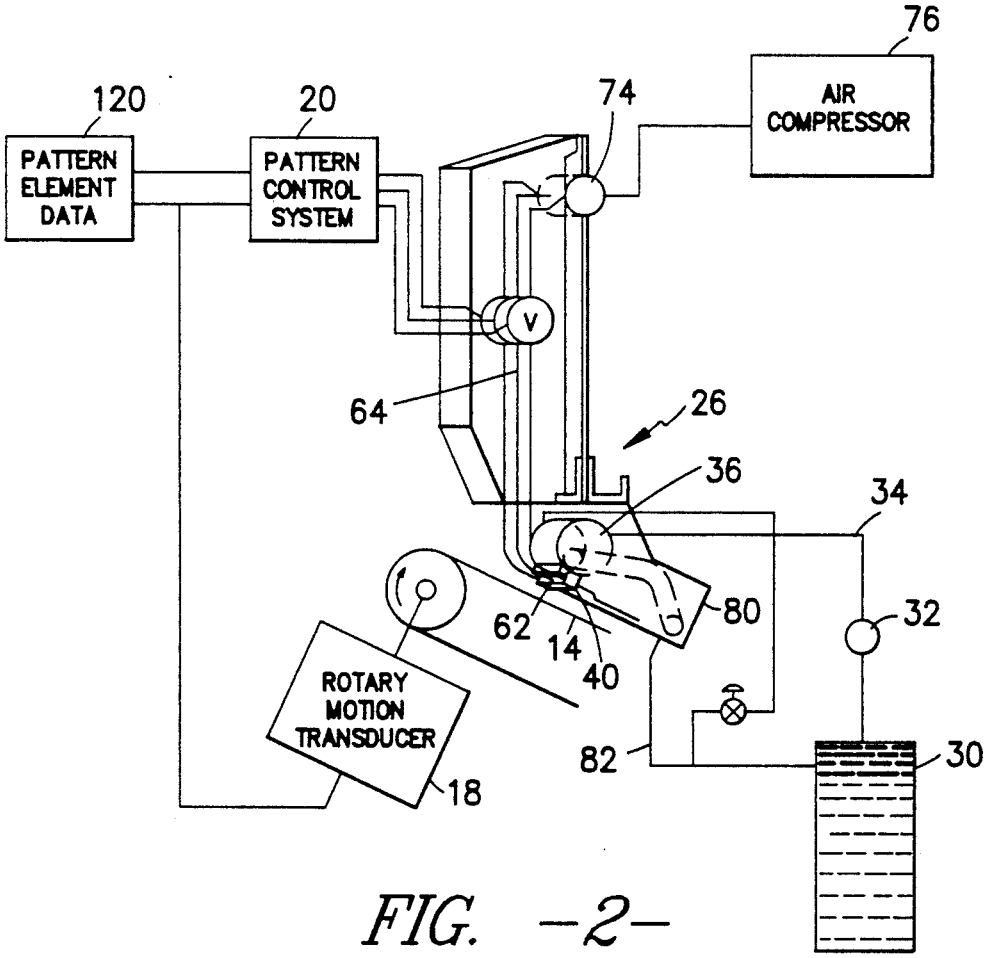
FIG. 2 represents a schematicized diagram of a portion of the apparatus of FIG. 1.

FIG. 2 depicts, in schematic form, a side elevation of one dye-emitting array of the machine of FIG. 1. For each array shown generally at 26, a separate dye reservoir tank 30 supplies liquid dye under pressure, by means of pump 32 and dye supply conduit means 34, to a primary dye manifold assembly 36 of the array. Primary manifold assembly 36 communicates with and supplies dye to dye sub-manifold assembly 40 (shown in greater detail in FIGS. 5 and 6) at suitable locations along their respective lengths. Both manifold assembly 36 and sub-manifold assembly 40 extend across the width of conveyor 14 on which the substrate to be dyed is transported. Sub-manifold assembly 40 is provided with a plurality of spaced, generally downwardly directed dye passage outlets 52 (shown, e.g. in FIG. 4) positioned across the width of conveyor 14 which produces a plurality of parallel dye streams which are directed onto the substrate surface to be patterned.

Figure 3:
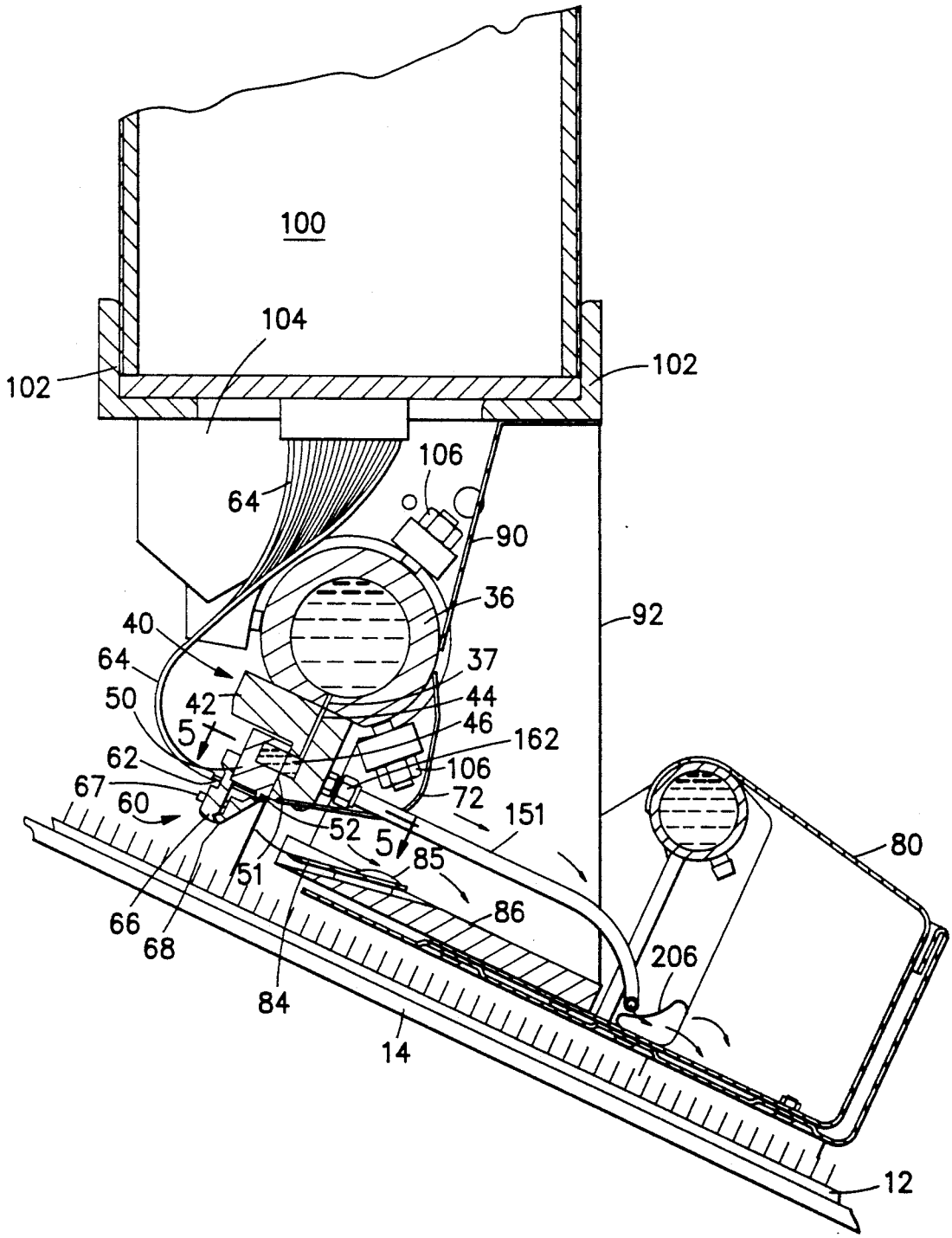
FIG. 3 is a diagrammatic side view of an array depicted in FIG. 1, representing the flow of fluid onto the textile web.
Figure 4:
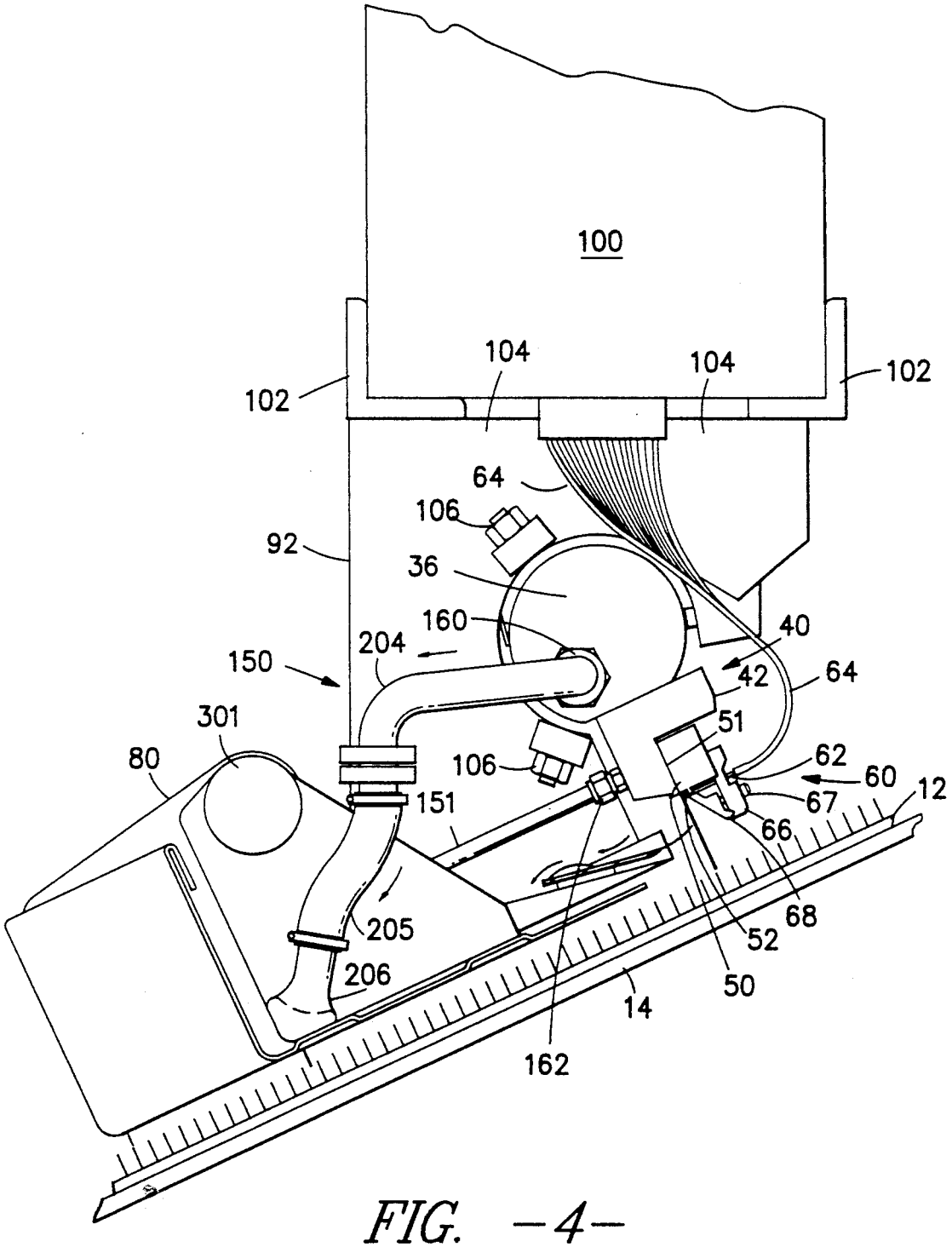
FIG. 4 is a diagrammatic opposite side view of an array depicted in FIG. 1, representing the flow of fluid onto the textile web.

As shown in FIGS. 2, 3, and 4, positioned in alignment with and approximately perpendicular to each dye passage outlet 52 in sub-manifold assembly 40 is the outlet of an air deflection tube 62. Each tube 62 communicates by way of an air supply conduit 64 with an individual air valve, illustrated collectively at "V" in FIG. 2, which valve selectively interrupts the flow of air to air tube 62 in accordance with pattern information supplied by pattern control device 20. There is a pattern element data source 120 which sends information to the pattern control device 20. Each valve is, in turn, connected by an air supply conduit to pressured air supplied by air compressor 76. Each of the valves V, which may be of the electromagnetic solenoid type, are individually controlled by electrical signals from a pattern control device 20. The outlets of deflection tubes 62 direct streams of air which are aligned with and impinge against the continuously flowing streams of dye flowing from dye passage outlets 52 and deflect such dye streams into a primary collection chamber or trough 80, from which liquid dye may be removed to dye reservoir tank 30 for recirculation.

The pattern control device 20 for operating solenoid valves V may be comprised of various pattern control means. The pattern element data source 120 provides desired pattern information to the pattern control device 20 to operate the solenoid valves. The pattern information is transmitted at appropriate times in response to movement by conveyor 14 which is detected by suitable rotary motion sensor or transducer means 18 operatively associated with the conveyor 14 and connected to control device 20. Details of one means to perform this function may be found in commonly assigned U.S. Pat. No. 4,033,154, issued Jul. 5, 1977, which disclosure is hereby incorporated by reference.

In a typical dyeing operation utilizing such apparatus, so long as no pattern information is supplied by control device 20 to the air valves V associated with the array of dye outlets 52, the valves remain "open" to permit passage of pressurized air from air manifold 74 through air supply conduits 64 to continuously deflect all of the continuously flowing dye streams from the dye outlets 52 into the primary collection chamber 80 for recirculation. When the substrate 12 initially passes beneath the dye outlets 52 of the individual arrays 26, pattern control device 20 is actuated in suitable manner, such as manually by operator. Thereafter, signals from transducer 18 prompt pattern information from pattern element data source 120. An example of a means of automatically and electronically changing from one pattern is disclosed in U.S. Pat. No. 4,170,883, issued Oct. 16, 1979, which is hereby incorporated by reference. As dictated by pattern information, pattern control device 20 generates control signals to selectively "close" appropriate air valves so that, in accordance with the desired pattern, deflecting air streams at specified individual dye outlets 52 along the arrays 26 are interrupted and the corresponding dye streams are not deflected, but instead are allowed to continue along their normal discharge paths to strike the substrate 12. Thus, by operating the solenoid air valves of each array in the desired pattern sequence, a colored pattern of dye is placed on the substrate during its passage under the respective array.

FIGS. 3 and 4 depict end views, in full section, of the arrays 26 of FIGS. 1 and 2 which are equipped with the invention disclosed herein. Individual support members 102 which are integrally attached to valve box 100, shown in FIG. 3, for each array 26 extend across conveyor 14 and are attached at each end to the diagonal frame members 24 shown in FIG. 1. Perpendicularly affixed at spaced locations along individual support beams 102 are plate-like mounting brackets 104, which provide support for primary dye manifold assembly 36 and associated apparatus, primary dye collection chamber 80 and associated apparatus, and the apparatus associated with the instant invention. In the preferred embodiment, valve boxes 100, supported by beams 102, may be used to house collectively the plurality of individual valves V, as well as the air manifold 74 associated with each array.

As depicted most clearly in FIGS. 3 and 4, primary dye manifold assembly 36 is comprised of a pipe having a flat mating surface which accommodates a corresponding mating surface on sub-manifold assembly 40. Sub-manifold assembly 40 is comprised of sub-manifold module section 42, grooved dye outlet module 50, and an elongate sub-manifold 46 cooperatively formed by elongate mating channels in sub-manifold module section 42 and outlet module 50. Sub-manifold module 42 is attached to primary dye manifold assembly 36 by bolts (not shown) or other suitable means so that drilled outlet conduits 37 in the mating surface of manifold assembly 36 and corresponding drilled passages 44 in the mating surface of sub-manifold 46 are aligned, thereby permitting pressurized liquid dye to flow from the interior of manifold assembly to elongate sub-manifold 46.

Associated with the mating face of dye outlet module 50 are a plurality of grooves or channels 51 which, when dye outlet module 50 is mated to sub-manifold module 42 as by bolts or other appropriate means (not shown), form dye passage outlets 52 through which uniform quantities of liquid dye from sub-manifold 46 may be directed onto the substrate 12 in the form of aligned, parallel streams. The relative position or alignment of dye channels 51 with respect to primary dye collector plate 84 and collector plate support member 86 may be adjusted by appropriate rotation of jacking screws 106 associated with mounting brackets 104.

Associated with dye outlet module 50 is deflecting air jet assembly 60, shown most clearly in FIG. 3, by which individual streams of air form air tubes 62 may be selectively directed, via an array of valves in valve box 100 and connecting supply conduits 64, across the path of respective dye streams. Assembly 60 is comprised of an air supply tube support plate 66 and air tube clamp 68, intended to align and secure individual air deflecting tubes 62 immediately outside dye outlets 52, as shown in FIG. 4. By rotating air tube clamp screw 67, the pressure exerted by clamp 68 on air tubes 62 may be adjusted. Airfoil 72, positioned generally opposite air tubes 62, is intended to reduce the degree of turbulence within the region of the array due to the action of the transverse air streams issuing from tubes 62. Although not shown, the protruding portion of dye outlet module 50 against which air clamp 68 urges tubes 62 is preferably configured with series of vee-shaped notches into which tubes 62 may partially be recessed. Further details of a similar alignment arrangement may be found in commonly assigned U.S. Pat. No. 4,309,881 which disclosure is hereby incorporated by reference.

When the liquid dye stream is deflected, the liquid dye exiting from dye passage outlets 52 is directed into primary dye collection chamber 80, which may be formed of suitable sheet material such as stainless steel and extends along the length of the array 26. Associated with collection chamber 80 is the primary dye collection plate 84 which is comprised of a thin flexible blade-like member which is positioned parallel and closely adjacent to dye passage outlets 52. Primary collector plate 84 may be adjustably attached at spaced locations along its length, as by bolt and spacer means 85, to wedge-shaped elongate collector plate support member 86, which forms an extension of the floor of primary collection chamber 80 and which is sharpened along the edge nearest the outlets 52 of dye discharge channels 51 and extends along the length of array 26. Any suitable adjustment means by which a thin, blade-like collector plate 84 may be mounted under tension along its length and aligned with the axes of dye outlet module grooves 51 may be employed; one such means is disclosed in commonly assigned U.S. Pat. No. 4,202,189 which disclosure is hereby incorporated by reference.

As shown in FIGS. 3 and 4, primary collection chamber 80 is positioned generally opposite the array of air deflection tubes 62 for the purpose of collecting liquid dye which has been diverted from the dye streams by the transverse air stream from tubes 62. Primary dye collection chamber 80 may be attached by conventional means to mounting brackets 104 as well as to sharpened collector plate support member 86, which may be rabbeted to accommodate the floor of chamber 80, as shown in FIG. 3. Shield 90 prevents wash water or dye, either in the form of droplets or airborne mist, from traveling between the manifold 36 and the valve box 100 and dripping onto and staining the substrate from that side of the array. Mist shield 92 is connected between the valve box 100 and the dye collection chamber 80. Both shields 90 and 92 and dye collection chamber 80 are preferably open at both ends so as to allow the pressurized air from air deflection tubes 62 to escape without undue restriction. There is a tray wash manifold 301 and series of nozzles for washing down tray 80.

Figure 5:
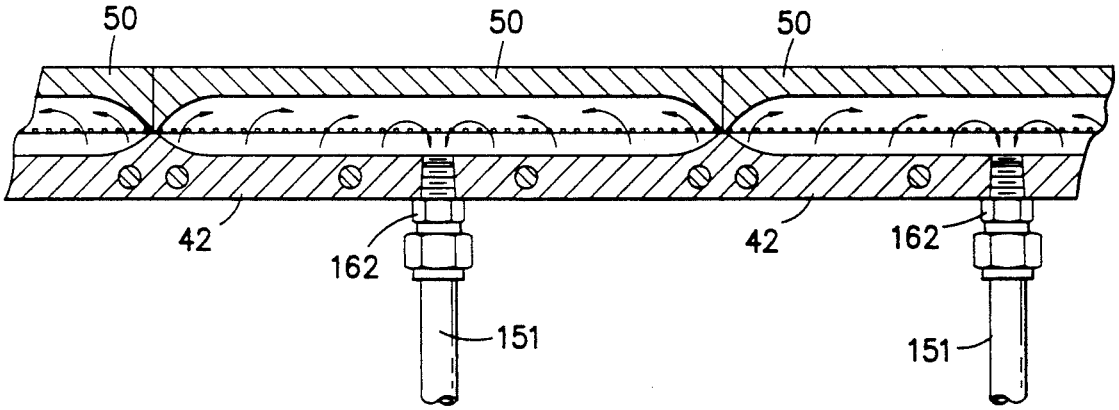
FIG. 5 is a cross-sectional view taken on line 5—5 of FIG. 3.

There are also a plurality of primary high velocity bypass tubes 151 that can be constructed out of as metal, plastic, rubber, and so forth, and the tubes 151 attach by means of conventional hardware (i.e., tubing fitting) 162 to the sub-manifold module 42. The tubes divert fluid into the collection chamber 80. The principal component of the instant invention, comprises of increasing the spacing of the tubes 151 from one every 7.62 centimeters to one every 11.43 to 60.96 centimeters with 15.24 centimeters utilized in the preferred embodiment. The flow rate can range from 0.2 liters/minute to 20 liters/minute with the preferred flow rate being at 4 liters/minute. Furthermore, the narrowest diameter of each bypass tube 151 can range from 2 millimeters to 7 millimeters with the preferred diameter being 3.2 millimeters. This presents a marked contrast to the previous flow rate of 1 liter/minute with a bypass manifold and downstream restriction. FIG. 5 discloses the new spacing of bypass tubes 151 and associated connections 162 to the sub-manifold module 42.

There can be a numerous plurality of secondary bypass tubes 151 that can run into collection chamber 80 and the other end of which is connected by another standard tubing connection to sub-manifold 44. It is preferred that the tubes 151 are directed so that dye flows in the same direction as tube 150, but this does not necessarily have to be the case. The flow rate can also vary widely with a preferred range between 1% and 90% and optimally 50% of submanifold flow.

An important advantage of the increased volume and spacing of tubes 151 is that with this increased flow rate, foam bubbles disappear out bypass tubes 151 and do not contact the substrate 12. The use of the increased flow rate and spacing of the bypass tubes 151 alleviates this problem.

There is a secondary bypass tube generally indicated as numeral 150 which allows excess dye to flow into the collection chamber 80 from the primary dye manifold assembly 36. As shown in FIG. 4, the tube 150 attaches by means of conventional hardware (i.e., tubing fitting) 160 to one end of the primary dye manifold assembly 36. The tube 150 can be made of a variety of materials such as metal, rubber, plastic, and so forth, with the preferred embodiment of tube 150 broken down in three sections with section 204 formed of metal, section 205 formed of rubber or plastic, and so forth, and section 206 formed of a relatively hardened substance such as metal or plastic. In the preferred embodiment, section 206 conforms to the bottom of the dye collection chamber 80. The bypass flow rate can be variable depending on the viscosity of the dye and quantity of diverted dye. The flow rate can range from 0.035 liters/minute to 100 liters/minute with the preferred flow rate being at 19 liters/minute. Furthermore, the narrowest diameter of the secondary bypass tube 150 can range from 0.35 millimeters to 25 millimeters with the preferred diameter being 7 millimeters.

In view of the above, it will be seen that various aspects and features of the invention are achieved and other advantageous results attained. While a preferred embodiment of the invention has been shown and described, it will be clear to those skilled in the art that changes and modifications may be made therein without departure from the invention in its broader aspect.

What is claimed:

1. An apparatus for applying liquids to a moving substrate comprising means for conveying the substrate in a predetermined path of travel, liquid applicator means having a row of outlets extending across and positioned above the substrate path for discharging a corresponding row of generally parallel, undeflected primary streams of liquid or a trajectory directed toward the substrate path, a source of electrically encoded pattern data, gas passage means positioned adjacent to said row of outlets and aligned with the discharge axes of the outlets for selectively deflecting, in accordance with pattern data from such data source, the trajectory of said primary streams of liquid emerging from said outlets with streams of gas from said gas passage means which intersect said primary streams of liquid, a liquid collection chamber positioned adjacent to said outlets and opposite from said gas passage means, said liquid collection chamber having an opening which extends along said row of outlets and which is positioned to receive said gas streams and primary liquid streams deflected by said gas streams and thereby prevent said streams from contacting said substrate, and a plurality of first liquid conduits operatively attached to said liquid applicator means and directed into said collection chamber.

2. The apparatus of claim 1, wherein each of said first liquid conduits has a flow rate in the range of 1 liter/minute to 15 liters/minute and spacing in the range of 12.7 centimeters to 30.48 centimeters between each adjacent first liquid conduit.

3. The apparatus of claim 1, wherein each of said first liquid conduits has a flow rate in the range of 2 liters/minute to 10 liters/minute and spacing in the range of 12.7 centimeters to 25.4 centimeters between each adjacent first liquid conduit.

4. The apparatus of claim 1, wherein each of said first liquid conduits has a flow rate in the range of 3 liters/minute to 7 liters/minute and spacing in the range of 12.7 centimeters to 20.32 centimeters between each adjacent first liquid conduit.

5. The apparatus of claim 1, wherein each of said first liquid conduits has a flow rate in the range of 3.5 liters/minute to 4.5 liters/minute and spacing in the range of 12.7 centimeters to 17.78 centimeters between each adjacent first liquid conduit.

6. The apparatus of claim 1, wherein each of said first liquid conduits has a flow rate of 4 liters/minute and spacing of substantially 15 centimeters between each adjacent first liquid conduit.

7. The apparatus of claim 1, wherein each of said first liquid conduits has a flow rate in the range of 0.2 liters/- minute to 20 liters/minute and a narrowest diameter in the range of 2 millimeters to 7 millimeters and spacing in the range of 11.43 centimeters to 60.96 centimeters between each adjacent first liquid conduit.

8. The apparatus of claim 1, wherein each of said first liquid conduits has a flow rate in the range of 1 liter/minute to 15 liters/minute and a narrowest diameter in the range of 2 millimeters to 6 millimeters and spacing in the range of 12.7 centimeters to 30.48 centimeters between each adjacent first liquid conduit.

9. The apparatus of claim 1, wherein each of said first liquid conduits has a flow rate in the range of 2 liters/minute to 10 liters/minute and a narrowest diameter in the range of 2 millimeters to 5 millimeters and spacing in the range of 12.7 centimeters to 25.4 centimeters between each adjacent first liquid conduit.

10. The apparatus of claim 1, wherein each of said first liquid conduits has a flow rate in the range of 3 liters/minute to 7 liters/minute and a narrowest diameter in the range of 2 millimeters to 4 millimeters and spacing in the range of 12.7 centimeters to 20.32 centimeters between each adjacent first liquid conduit.

11. The apparatus of claim 1, wherein each of said first liquid conduits has a flow rate in the range of 3.5 liters/minute to 4.5 liters/minute and a narrowest diameter in the range of 2 millimeters to 3.5 millimeters and spacing in the range of 12.7 centimeters to 17.78 centimeters between each adjacent first liquid conduit.

12. The apparatus of claim 1, wherein each of said first liquid conduits has a flow rate of 4 liters/minute and a narrowest diameter of 3.2 millimeters and spacing of substantially 15 centimeters between each adjacent first liquid conduit.

13. An apparatus for applying liquids to a moving substrate comprising means for conveying the substrate in a predetermined path of travel, liquid applicator means having a row of outlets extending across and positioned above the substrate path for discharging a corresponding row of generally parallel, undeflected primary streams of liquid on a trajectory directed toward the substrate path, a source of electrically encoded pattern data, gas passage means positioned adjacent to said row of outlets and aligned with the discharge axes of the outlets for selectively deflecting, in accordance with pattern data from such data source, the trajectory of said primary streams of liquid emerging from said outlets with streams of gas from said gas passage means which intersect said primary streams of liquid, a liquid collection chamber positioned adjacent to said outlets and opposite from said gas passage means, said liquid collection chamber having an opening which extends along said row of outlets and which is positioned to receive said gas streams and primary liquid streams deflected by said gas streams and thereby prevent said streams from contacting said substrate, a plurality of first liquid conduits operatively attached to said liquid applicator means and directed into said collection chamber and a second liquid conduit operatively attached to said liquid applicator means and directed into said collection chamber.

14. The apparatus of claim 13, wherein each of said first liquid conduits has a flow rate in the range of 1 liter/minute to 15 liters/minute and spacing in the range of 12.7 centimeters to 30.48 centimeters between each adjacent first liquid conduit and said second liquid conduit has a flow rate in the range of 1 liter/minute to 80 liters/minute.

15. The apparatus of claim 13, wherein each of said first liquid conduits has a flow rate in the range of 2 liters/minute to 10 liters/minute and spacing in the range of 12.7 centimeters to 25.4 centimeters between each adjacent first liquid conduit and said second liquid conduit has a flow rate in the range of 5 liters/minute to 50 liters/minute.

16. The apparatus of claim 13, wherein each of said first liquid conduits has a flow rate in the range of 3 liters/minute to 7 liters/minute and spacing in the range of 12.7 centimeters to 20.32 centimeters between each adjacent first liquid conduit and said second liquid conduit has a flow rate in the range of 10 liters/minute to 35 liters/minute.

17. The apparatus of claim 13, wherein each of said first liquid conduits has a flow rate in the range of 3.5 liters/minute to 4.5 liters/minute and spacing in the range of 12.7 centimeters to 17.78 centimeters between each adjacent first liquid conduit and said second liquid conduit has a flow rate in the range of 15 liters/minute to 20 liters/minute.

18. The apparatus of claim 13, wherein each of said first liquid conduits has a flow rate of 4 liters/minute and spacing of substantially 15 centimeters between each adjacent first liquid conduit and said second liquid conduit has a flow rate of 19 liters/minute.

19. The apparatus of claim 13, wherein each of said first liquid conduits has a flow rate in the range of 0.2 liters/minute to 20 liters/minute and spacing in the range of 11.43 centimeters to 60.96 centimeters between each adjacent first liquid conduit and said second liquid conduit has a flow rate in the range of 0.035 liters/minute to 100 liters/minute and the narrowest diameter of said second liquid conduit ranges between 0.35 millimeters and 25 millimeters.

20. The apparatus of claim 13, wherein each of said first liquid conduits has a flow rate in the range of 1 liter/minute to 15 liters/minute and spacing in the range of 12.7 centimeters to 30.48 centimeters between each adjacent first liquid conduit and said second liquid conduit has a flow rate in the range of 1 liter/minute to 80 liters/minute and the narrowest diameter of said second liquid conduit ranges between 1 millimeter and 15 millimeters.

21. The apparatus of claim 13, wherein each of said first liquid conduits has a flow rate in the range of 2 liters/minute to 10 liters/minute and spacing in the range of 12.7 centimeters to 25.4 centimeters between each adjacent first liquid conduit and said second liquid conduit has a flow rate in the range of 5 liters/minute to 50 liters/minute and the narrowest diameter of said second liquid conduit ranges between 2 millimeters and 11 millimeters.

22. The apparatus of claim 13, wherein each of said first liquid conduits has a flow rate in the range of 3 liters/minute to 7 liters/minute and spacing in the range of 12.7 centimeters to 20.32 centimeters between each adjacent first liquid conduit and said second liquid conduit has a flow rate in the range of 10 liters/minute to 35 liters/minute and the narrowest diameter of said second liquid conduit ranges between 3 millimeters and 9.5 millimeters.

23. The apparatus of claim 13, wherein each of said first liquid conduits has a flow rate in the range of 3.5 liters/minute to 4.5 liters/minute and spacing in the range of 12.7 centimeters to 17.78 centimeters between each adjacent first liquid conduit and said second liquid conduit has a flow rate in the range of 15 liters/minute to 20 liters/minute and the narrowest diameter of said second liquid conduit ranges between 6 millimeters and 7.5 millimeters.

24. The apparatus of claim 13, wherein each of said first liquid conduits has a flow rate of 4 liters/minute and spacing of substantially 15 centimeters between each adjacent first liquid conduit and said second liquid conduit has a flow rate of 19 liters/minute and the narrowest diameter of said second liquid conduit is 7 millimeters.

25. The apparatus of claim 1, wherein each of said first liquid conduits has a flow rate in the range of 0.2 liters/minute to 20 liters/minute and spacing in the range of 11.43 centimeters to 60.96 centimeters between each adjacent first liquid conduit.

26. The apparatus of claim 13, wherein each of said first liquid conduits has a flow rate in the range of 0.2 liters/minute to 20 liters/minute and spacing in the range of 11.43 centimeters to 60.96 centimeters between each adjacent first liquid conduit and said second liquid conduit has a flow rate in the range of 0.035 liters/minute to 100 liters/minute.

* * * * *